US006099247A

United States Patent [19]

Nishio

[11] Patent Number: 6,099,247

[45] Date of Patent: Aug. 8, 2000

[54] FAN SHROUD FOR INTERNAL COMBUSTION ENGINE

[75] Inventor: Yasuaki Nishio, Shizuoka-Ken, Japan

[73] Assignee: Suzuki Motor Corporation, Japan

[21] Appl. No.: 09/213,500

[22] Filed: Dec. 17, 1998

[30] Foreign Application Priority Data

Dec. 26, 1997 [JP] Japan ..... 9-367683

[51] Int. Cl.[7] ..... F04D 29/52; F01P 11/10

[52] U.S. Cl. ..... 415/173.1; 415/211.1; 415/220; 415/178; 416/169 A; 416/189; 123/41.49

[58] Field of Search ..... 415/173.1, 173.6, 415/208.1, 211.1, 220, 223, 176–178; 416/169 A, 189, 191, 192; 123/41.49

[56] References Cited

U.S. PATENT DOCUMENTS 3,295,749 1/1967 Bedell et al. ..... 415/178
5,951,247 9/1999 Rockwell et al. ..... 415/223

FOREIGN PATENT DOCUMENTS 63-67620 5/1988 Japan .

*Primary Examiner*—Christopher Verdier
*Attorney, Agent, or Firm*—Morrison Law Firm

[57] ABSTRACT

A fan shroud for an internal combustion engine has a greater clearance from the cooling fan on the exhaust side of the engine than on the suction side. The greater clearance on the exhaust side aggressively increases the flow of cooling air on the exhaust side in the engine compartment. This equalizes the temperature throughout the engine, thereby reducing engine damage due to overheating.

8 Claims, 5 Drawing Sheets

FAN SHROUD FOR INTERNAL COMBUSTION ENGINE

The present invention relates to a fan shroud for an internal combustion engine. In particular, the invention relates to a fan shroud equipped with a ring body encircling a cooling fan which cools a radiator attached to the internal combustion engine.

An internal combustion engine of a vehicle is cooled by water from a radiator. The water absorbs the engine's heat and heats up, and is cooled by a cooling device such as a fan. The cooling fan is attached to the internal combustion engine by a fan shaft. The radiator is placed at the forward position of the vehicle. A fan shroud with a ring body, attached to this radiator, encircles the cooling fan at a specified clearance.

Referring to FIGS. 7–9, an internal combustion engine 112 is placed longitudinally inside a body 106 in an engine compartment 104 of a vehicle 102. An intake manifold 108, such as a suction system part, is attached to one side of internal combustion engine 112, and an exhaust manifold 110 is attached to the other side. At the front of vehicle 102, a cooling fan 116 is attached by a fan shaft 114 to internal combustion engine 112. A radiator 120 is installed on cross member 118 of body 106, opposite cooling fan 116. Attached to radiator 120 is a fan shroud 124, equipped with a ring body 122 which encircles cooling fan 116 at a specified clearance C. Ring body 122 is formed as a circle.

Clearance C between cooling fan 116 and ring 122 of fan shroud 124 is made comparatively large, for example around 20–30 mm, because cooling fan 116 moves with the vibrations of internal combustion engine 112. Shaft center 114*c* of fan shaft 114, which is the center of cooling fan 116, and ring center 122*c* of ring body 122, the center of fan shroud 124, are at approximately the same position.

Referring to FIG. 10, when vehicle 102 bounces and lands, internal combustion engine 112 moves a large amount in the downward direction due to the resilient mounting of internal combustion engine 112. In order to avoid contact between cooling fan 116 and ring body 122, ring center 122*c* is slightly lower than the shaft center 114*c*. Lower clearance C3 is thereby made larger than upper clearance C4.

This kind of fan shroud is disclosed in Japanese Utility Model Laid-Open Publication No. 63-67620. In this publication, the fan cover fixed to the radiator body has an elliptical cross-sectional shape. The shorter dimension measures a specified clearance added to the diameter of the cooling fan.

Referring to FIG. 7, when internal combustion engine 112 is placed longitudinally inside the engine compartment 104, the side of internal combustion engine 112 with the exhaust system is hotter than the side with the intake or suction system. Cooling air from cooling fan 116 enters the suction side and the exhaust side from clearance C at approximately the same rate. Consequently, the temperature in the engine compartment 104 is higher on the exhaust side. Heat can accumulate and damage the engine.

OBJECT AND SUMMARY OF THE INVENTION

It is therefore an object of the present invention to provide a fan shroud that overcomes the limitations of the prior art.

It is another object of the present invention to provide a fan shroud that directs air from a cooling fan preferentially to one side over another, where more cooling is needed.

Briefly stated, the present invention provides a fan shroud for an internal combustion engine with a greater clearance from the cooling fan on the exhaust side of the engine than on the suction side. The greater clearance on the exhaust side aggressively increases the flow of cooling air on the exhaust side in the engine compartment. This equalizes the temperature throughout the engine, thereby reducing engine damage due to overheating.

According to an embodiment of the invention, there is provided a fan shroud for an internal combustion engine, the internal combustion engine being of a type having suction system parts attached to a suction side and exhaust system parts attached to an exhaust side, comprising: a cooling fan rotatable by a shaft in front of the internal combustion engine, a radiator behind the cooling fan, the fan shroud surrounding the cooling fan for directing cooling air through the radiator, the cooling air, after passage through the radiator, passing onto the internal combustion engine, and a clearance between the cooling fan and the fan shroud being greater on the exhaust side than on the suction side, whereby cooling air is preferentially directed to the exhaust side.

According to a feature of the invention, there is provided a fan shroud for an internal combustion engine comprising: a ring body with a ring axis, the ring body being fitted about a perimeter of a fan, the fan having a fan axis, the ring body being one of substantially circular and substantially elliptical, but bulging outward at one side sufficient to cool one side of the internal combustion engine preferentially over another side thereof According to a further feature of the invention, there is provided a fan shroud for cooling an internal combustion engine comprising: a ring body with a ring axis, a fan with a fan axis, and the ring body being substantially elliptical, the ring axis being displaced from the fan axis, whereby cooling of one side of the internal combustion engine is enhanced compared to another side thereof The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

In this invention, clearance between the cooling fan and the fan shroud at the exhaust side is larger than the clearance at the suction side, thereby aggressively increasing the amount cooling air on the exhaust side. This avoids the accumulation of heat on the exhaust side and prevents heat damage. One embodiment of the present invention is shown in FIGS. 1–4.

Figure 4:
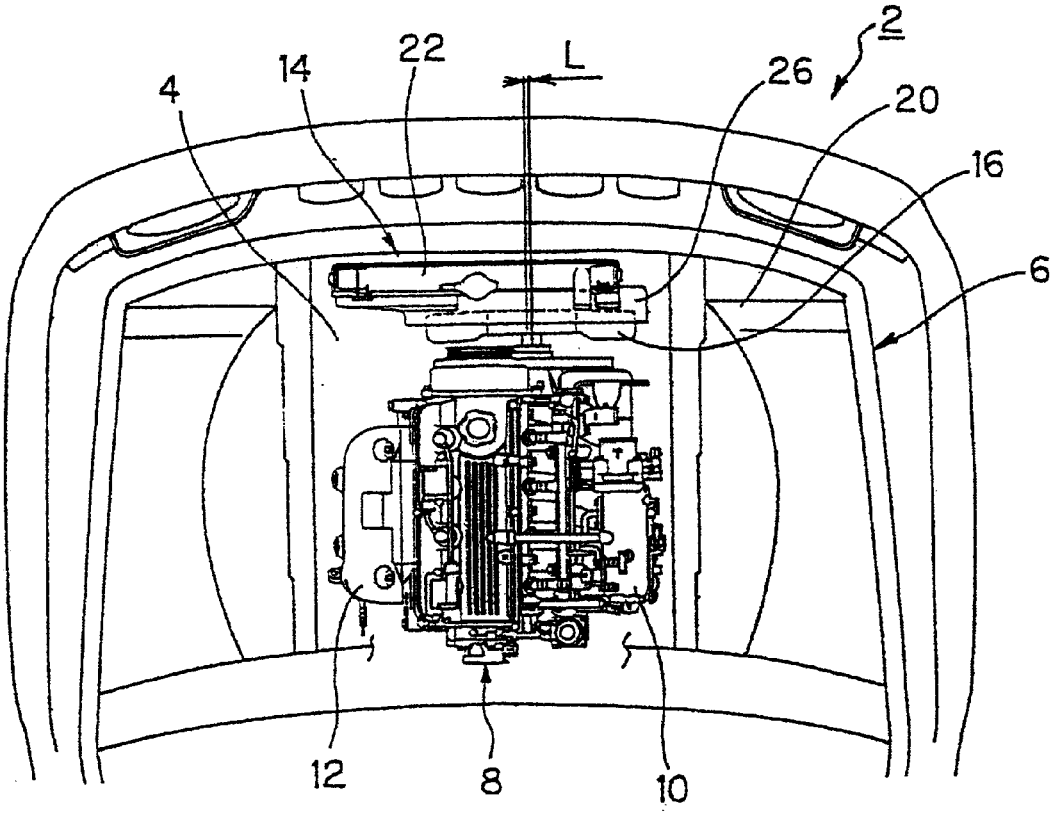
FIG. 4 is a plan view of an engine compartment of a vehicle.

Referring to FIG. 4, vehicle 2 may be a four-wheel-drive automobile. In body 6, an internal combustion engine 8 is placed longitudinally inside engine compartment 4.

An intake manifold 10 or the like, denoted the suction system, is attached to one side (e.g. the right side) of internal combustion engine 8. An exhaust manifold 12 or the like, denoted the exhaust system, is attached to the other side (e.g. the left side).

A cooling device 14 includes a cooling fan 16 attached to internal combustion engine 8 by a fan shaft 18 in the forward direction of vehicle 2. A radiator 22 faces cooling fan 16 on the cross member 20 of body 6.

A fan shroud 26 equipped with a ring body 24 which surrounds cooling fan 16 is attached to radiator 22. Ring body 24 may be, for example, substantially a circle.

Figure 1:
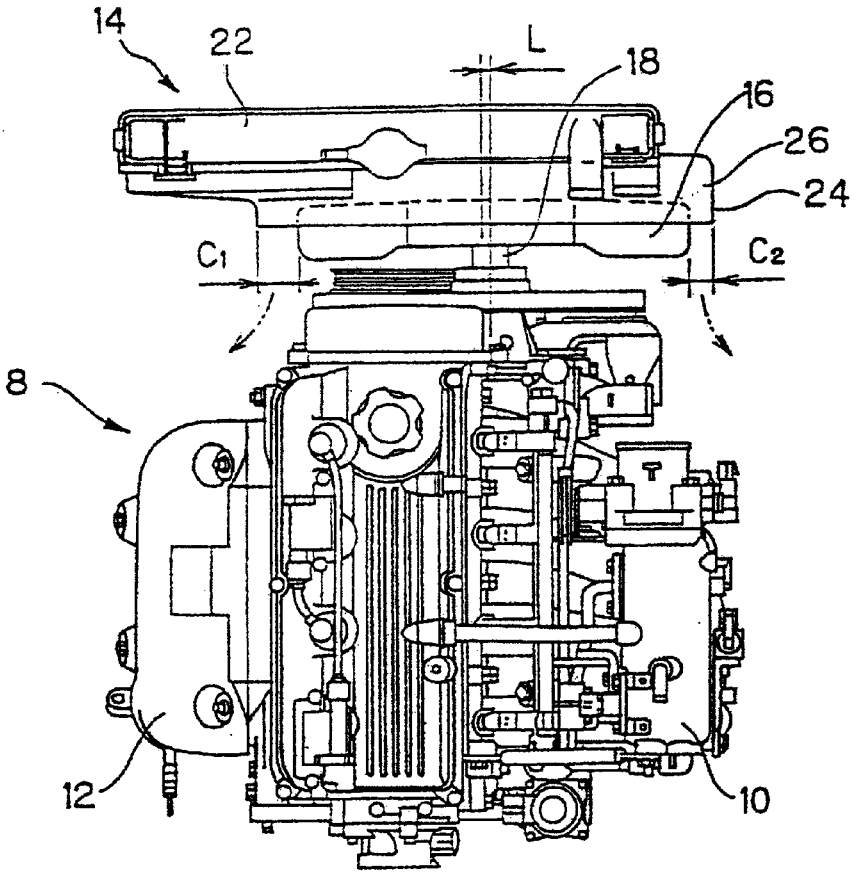
FIG. 1 is a plan view of the internal combustion engine according to an embodiment of the present invention.
Figure 2:
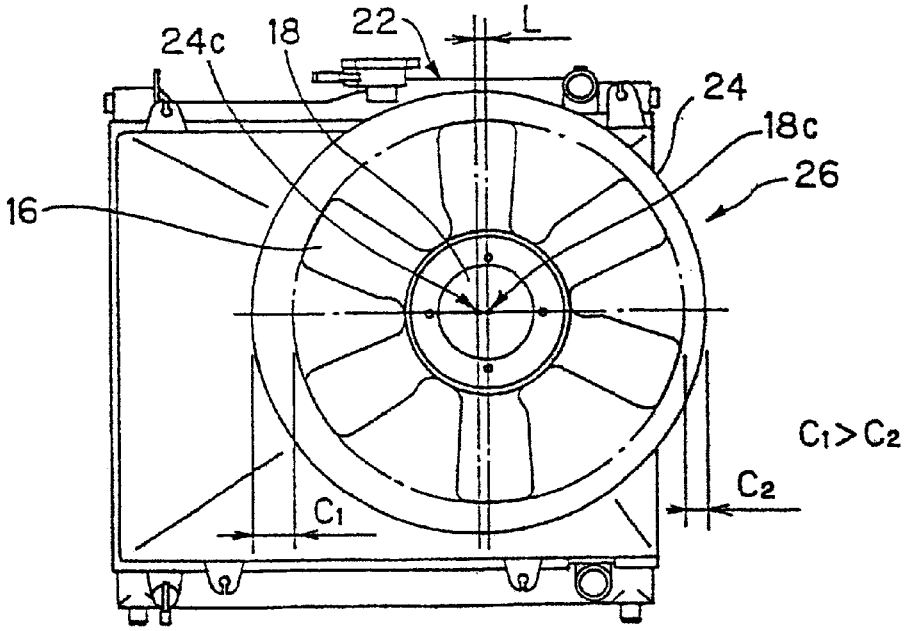
FIG. 2 is a rear view of the radiator in FIG. 1.
Figure 3:
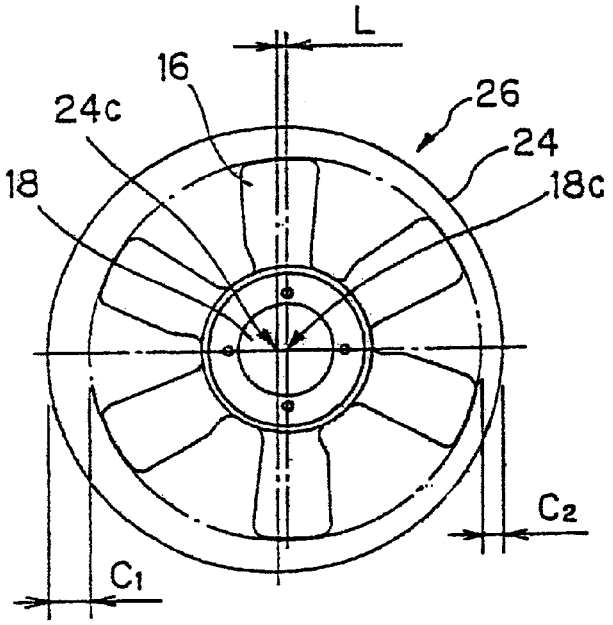
FIG. 3 is a descriptive figure of the clearance between the cooling fan and the ring piece in FIG. 2.

Referring to FIGS. 2 and 3, the exhaust side clearance $C_1$ is larger than the suction side clearance $C_2$. This is accomplished by offsetting ring center 24*c* of ring body 24 a distance L from shaft center 18*c* of fan shaft 18.

The embodiment operates as follows:

Exhaust side clearance $C_1$ between cooling fan 16 and ring body 24, is larger than suction side clearance $C_2$. As a result, cool air aggressively increases on the exhaust side of engine compartment 4, cooling the exhaust system parts such as exhaust manifold 12. Heat accumulated inside engine compartment 4 is stirred up, and the temperature on the exhaust side is lowered. The temperature inside engine compartment 4 is approximately uniform, thereby preventing heat damage.

No separate parts are needed inside engine compartment 4 to increase cool air on the exhaust side. Construction is simple and inexpensive.

Figure 5:
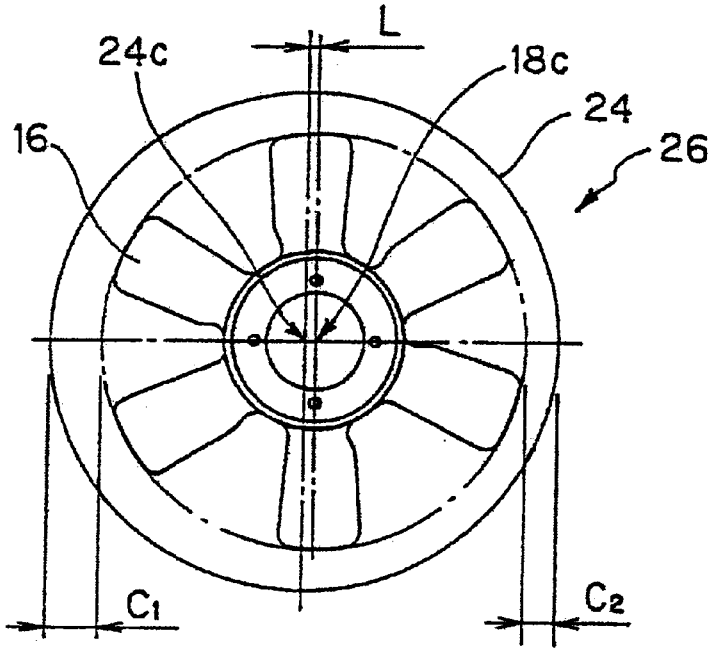
FIG. 5 shows the clearance between the cooling fan and the ring piece in an alternate embodiment of the invention.

Referring to FIG. 5, ring body 24 is elliptical, in addition to having ring center 24*c* offset a distance L from shaft center 18*c*. In this case, exhaust side clearance $C_1$ is even larger than before relative to suction side clearance $C_2$.

Figure 6:
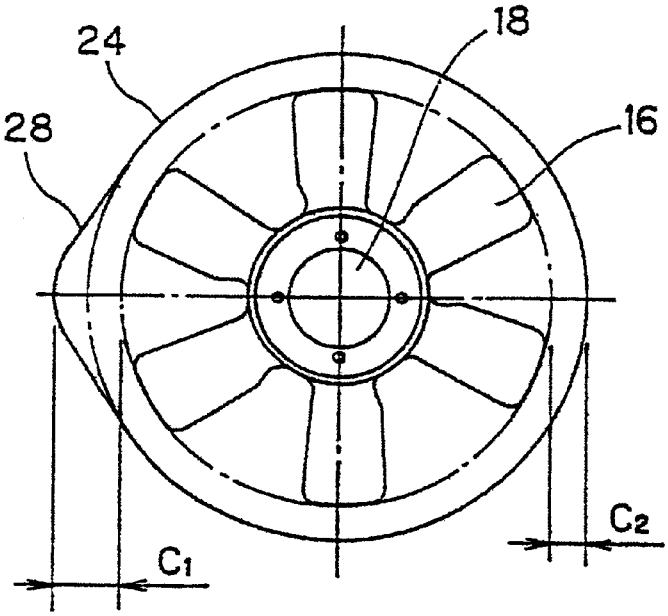
FIG. 6 shows another embodiment of the invention, illustrating the addition of a clearance expansion area.
Figure 7:
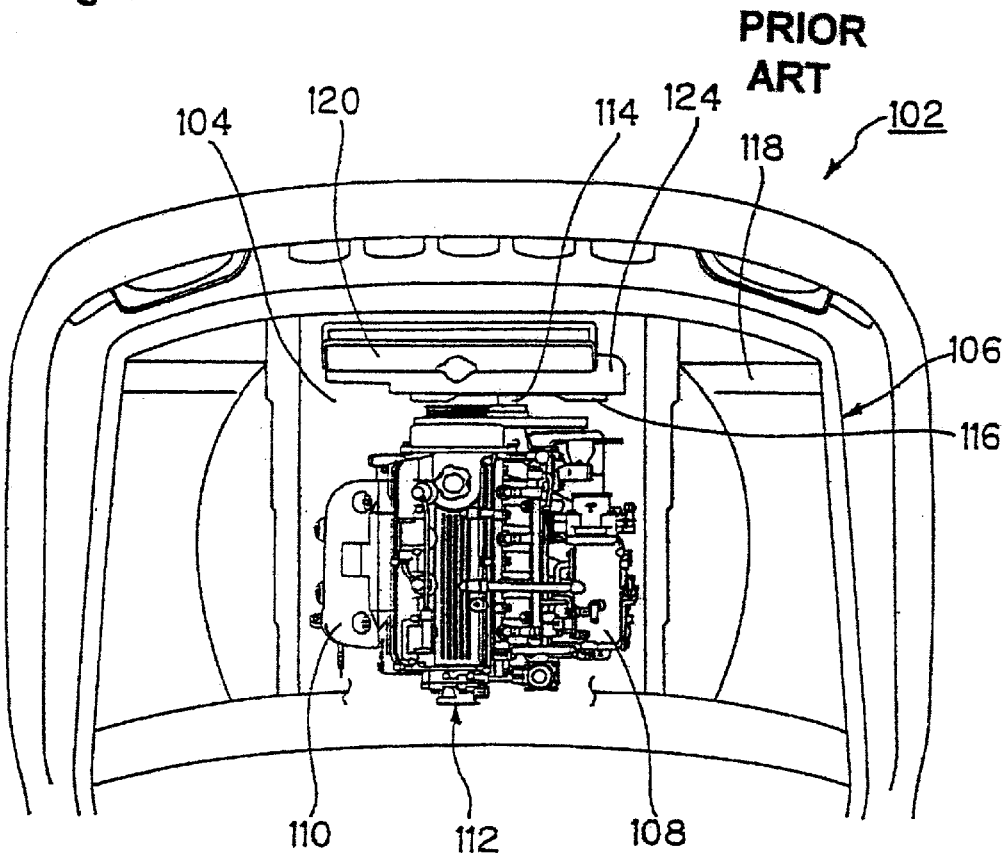
FIG. 7 is a plan view of a vehicle of the prior art.
Figure 8:
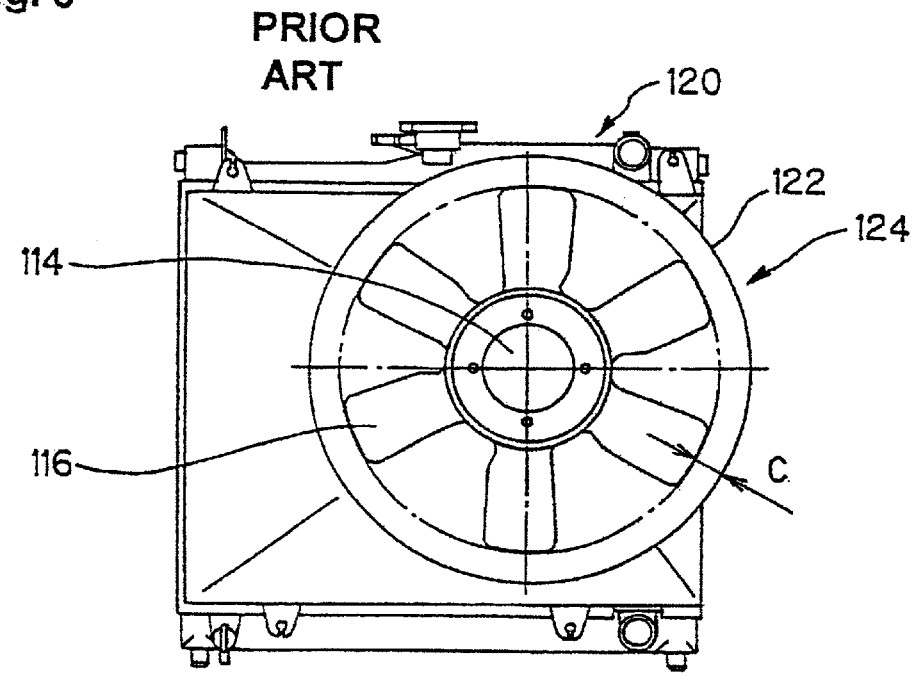
FIG. 8 is a view from the rear of a radiator of the prior art.
Figure 9:
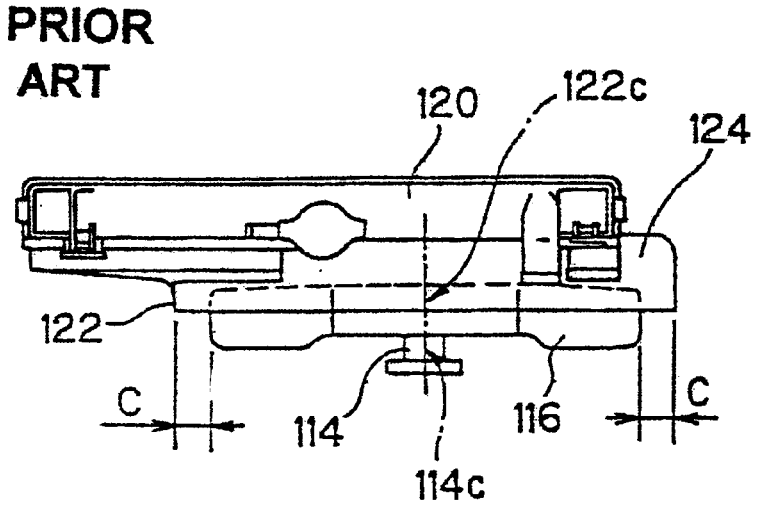
FIG. 9 is a plan view of a radiator of FIG. 8.
Figure 10:
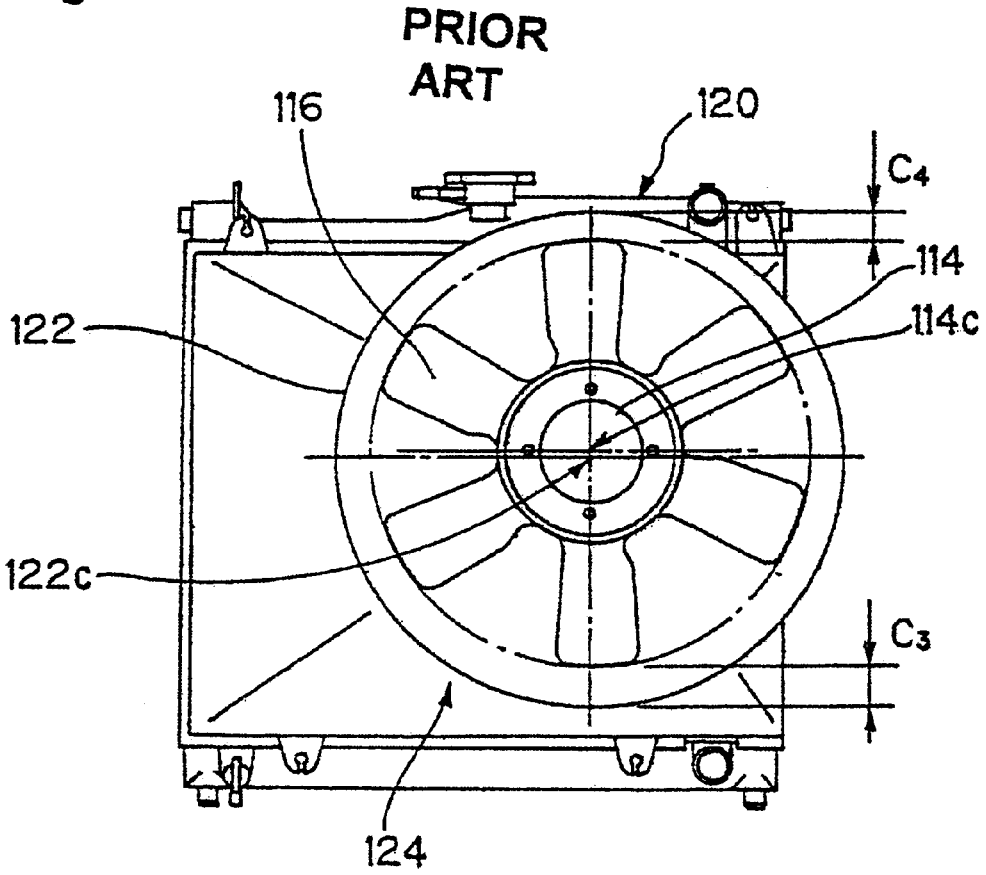
FIG. 10 is a back view of another radiator of the prior art.

Referring to FIG. 6, ring center 24*c* is coaxial with shaft center 18*c*; i.e. to set the offset L to zero. Ring body 24 can be either circular or elliptical. On the exhaust side, a clearance expansion area 28 is formed so that exhaust clearance $C_1$ is locally expanded. This results in the directional flow of cooling air, increasing the airflow to the exhaust system, and efficiently lowering the temperature on the exhaust side of engine compartment 4.

From the invention described in detail above, the clearance between the cooling fan and the ring body is greater on the exhaust side of the engine compartment than on the suction side. As a result cooling air is aggressively increased on the exhaust side, thereby avoiding heat accumulation and preventing heat damage to the engine.

Construction is simple and inexpensive because no separate parts are needed to increase the cooling air on the exhaust side.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A fan shroud for an internal combustion engine comprising:

a ring body with a ring axis;

said ring body being fitted about a perimeter of a fan;

said fan having a fan axis;

said ring body being one of substantially circular and substantially elliptical, but bulging outward at one side sufficient to cool one side of said internal combustion engine preferentially over another side thereof when said fan shroud is assembled to said internal combusion engine.

2. A fan shroud according to claim 1, wherein said fan axis is substantially coaxial with said ring axis.

3. A fan shroud for cooling an internal combustion engine having an exhaust side and an intake side comprising:

a ring body with a ring axis;

a fan with a fan axis;

said ring body being substantially elliptical;

said ring axis being displaced from said fan axis along an axis of an ellipse of said ring body, whereby cooling of an exhaust side of said internal combustion engine is enhanced compared to an intake side thereof.

4. A fan shroud for an internal combustion engine of a type having a radiator and a cooling fan, said internal combustion engine being of a type having an intake side having suction system parts attached to a suction side and an exhaust side having exhaust system parts attached thereto, comprising:

said cooling fan being rotatable by a shaft in front of said internal combustion engine;

said radiator being disposed in an air flow path of said cooling fan;

said fan shroud surrounding said cooling fan for directing cooling air through said radiator;

said cooling air, after passage through said radiator, passing onto said internal combustion engine; and a clearance between said cooling fan and said fan shroud being greater on said exhaust side than on said suction side, whereby cooling air is preferentially directed to said exhaust side.

5. A fan shroud for an internal combustion engine of claim 1, wherein:

said cooling fan includes a fan axis;

said fan shroud includes a shroud axis; and said shroud axis is displaced toward said exhaust side, whereby said clearance at said exhaust side is enlarged compared to said clearance at said suction side.

6. A fan shroud according to claim 1, wherein:

said fan shroud includes a clearance expansion area in said fan shroud; and said clearance expansion area being locally enlarged to preferentially direct cooling air to said exhaust side.

7. A fan shroud according to claim 6 wherein said fan shroud is substantially circular, except for said clearance area.

8. A fan shroud according to claim 1, wherein:

said fan shroud has a substantially elliptical shape;

a major axis of said elliptical shape being directed along a line between said suction side and said exhaust side;

said cooling fan includes a fan axis;

said fan shroud includes a shroud axis; and said shroud axis is displaced toward said exhaust side, whereby said clearance at said exhaust side is enlarged compared to said clearance at said suction side.

* * * * *